United States Patent [19]

Forster

[11] Patent Number: 4,628,555

[45] Date of Patent: Dec. 16, 1986

[54] INNERSPRING MATTRESS

[76] Inventor: Peter Forster, Flurstrasse 1, 8506 Langenzenn, Fed. Rep. of Germany

[21] Appl. No.: 657,123

[22] Filed: Oct. 3, 1984

[30] Foreign Application Priority Data

Oct. 6, 1983 [DE] Fed. Rep. of Germany ..... 3336324

[51] Int. Cl.[4] ..... A47C 23/02; A47C 20/00

[52] U.S. Cl. ..... 5/247; 5/255; 5/258; 5/447; 5/241; 5/261

[58] Field of Search ..... 5/241, 247, 255, 258, 5/261, 446, 447, 475, 476, 465, DIG. 2; 128/33

[56] References Cited

U.S. PATENT DOCUMENTS

| | | | |
|---|---|---|---|
| 59,470 | 11/1866 | Snore | 5/241 |
| 100,635 | 3/1870 | Johnston | 5/247 |
| 213,561 | 3/1879 | Gordon | 5/447 |
| 488,060 | 12/1892 | Bunker | 5/255 |
| 991,086 | 5/1911 | Price | 5/247 |
| 1,943,067 | 1/1934 | Foster | 5/248 |
| 2,321,817 | 6/1943 | Hutton | 5/247 |
| 3,031,690 | 5/1962 | Ramsay | 5/DIG. 2 |
| 3,316,568 | 5/1967 | Janapol | 5/465 |
| 3,340,548 | 9/1967 | Janapol | 5/243 |
| 4,190,914 | 3/1980 | Diallo | 5/255 |
| 4,383,342 | 5/1983 | Forster | 5/432 |

*Primary Examiner*—Gary L. Smith
*Assistant Examiner*—Michael F. Trettel
*Attorney, Agent, or Firm*—Hill, Van Santen, Steadman & Simpson

[57] ABSTRACT

An innerspring mattress comprising a plurality of wire or flat spiral springs which have securement ends secured to the mattress frame and support ends supporting an elastic material surface on which the springs are designed and positioned such that a respective work axis of spring force of the springs describe an angle relative to a perpendicular of the frame, said angle being greater than 0°.

3 Claims, 9 Drawing Figures

CONTROL UNIT
60

INNERSPRING MATTRESS

BACKGROUND OF THE INVENTION

The invention relates to an innerspring mattress comprising a plurality of wire or flat spiral springs whose ends are secured to the mattress frame and at the other ends of which the user lies.

Given known innerspring mattresses of this type, the working axes of the spring forces are oriented perpendicular to the mattress frame, so that practically the only forces that can be exerted on the user are forces acting perpendicular to the surface of his skin. Tensile forces, particularly in the longitudinal direction of the spinal column do not occur given known innerspring mattresses.

An elastic material support is already known (German OS No. 30 10 122, incorporated herein by reference) wherein the ribs or naps are aligned such that they are obliquely directed toward the leg region in the region of the buttocks and are obliquely directed toward the head in the back region. A stretching effect is thereby exerted on the body of a person lying or sitting on the support. According to statistics, however, mattresses manufactured of elastic materials, particularly mattresses of expanding materials are accepted by only about 30% of the population.

SUMMARY OF THE INVENTION

An object of the invention is to improve an innerspring mattress of the type initially cited for employment as a bed mattress, upholstered furniture, and chairs such that forces having their working lines along the surface of the user are exerted at the surface of the user in addition to working lines perpendicular thereto.

This object is achieved in that the springs are designed and arranged such that the respective work axis of the spring force describes an angle with the perpendicular to the respective frame part that deviates from 0°. The spring force can thus be dissected into a force component lying perpendicular to the frame part and into a force component lying approximately horizontal. This horizontally disposed component exerts a stretching effect on the user. A massaging effect is thus achieved given movements of the user on the innerspring mattress. The usually standard mattress underframe (bed frame) is superfluous given the innerspring mattress of the invention. The integrated frame defines the straight lying posture during sleep for the innerspring mattress. A hammock effect possibly produced due to the known underframe or bed frame which leads to an unfavorable strain on the spinal column is thus suppressed. A stronger massaging and stretching effect can be achieved with the obliquely placed springs in comparison to the known ribs or naps of expanding materials or rubber since the section modulus of a laterally loaded spring is lower than that of the ribs or naps.

A further development of the invention is that there is no fixed connection between the supporting ends of the springs. The springs can thus spring or yield in punctiform manner in a particularly easy fashion. They can be covered by elastic material at their supporting ends. The mattress surface thus automatically adapts particularly well to the different body contours in back, side, and stomach positions of the user and thus insures a straight attitude of the spinal column in all positions.

The springs can be secured in rows to parallel axes which can be rotatably seated. When detents are allocated to the springs, then the springs can be pre-stressed by means of twisting the axes. The relieving or balancing force acting both perpendicular to the mattress as well as in a horizontal direction is adjustable in a simple manner in this fashion. Given design of the mattress as an extension mattress for the spine for a person lying on a mattress placed on a hard surface, for example, the possibility thus exists of transferring an infinitely variable relieving force from 0 through 20% of the body weight to the back of the person by means of actuating a central adjustment.

The innerspring mattress of the invention opens up new possibilities of an extension bearing, of a rhythmic extension bearing, and of massaging the prone supporting surface of the body for therapeutic application in clinics, particularly given a motorized central adjustment such as an oscillating adjustment of the spring pre-stress.

DESCRIPTION OF THE PREFERRED EMBODIMENTS

Figures 1, 2, 3, 4, 5, 6, 7, 8, 9:
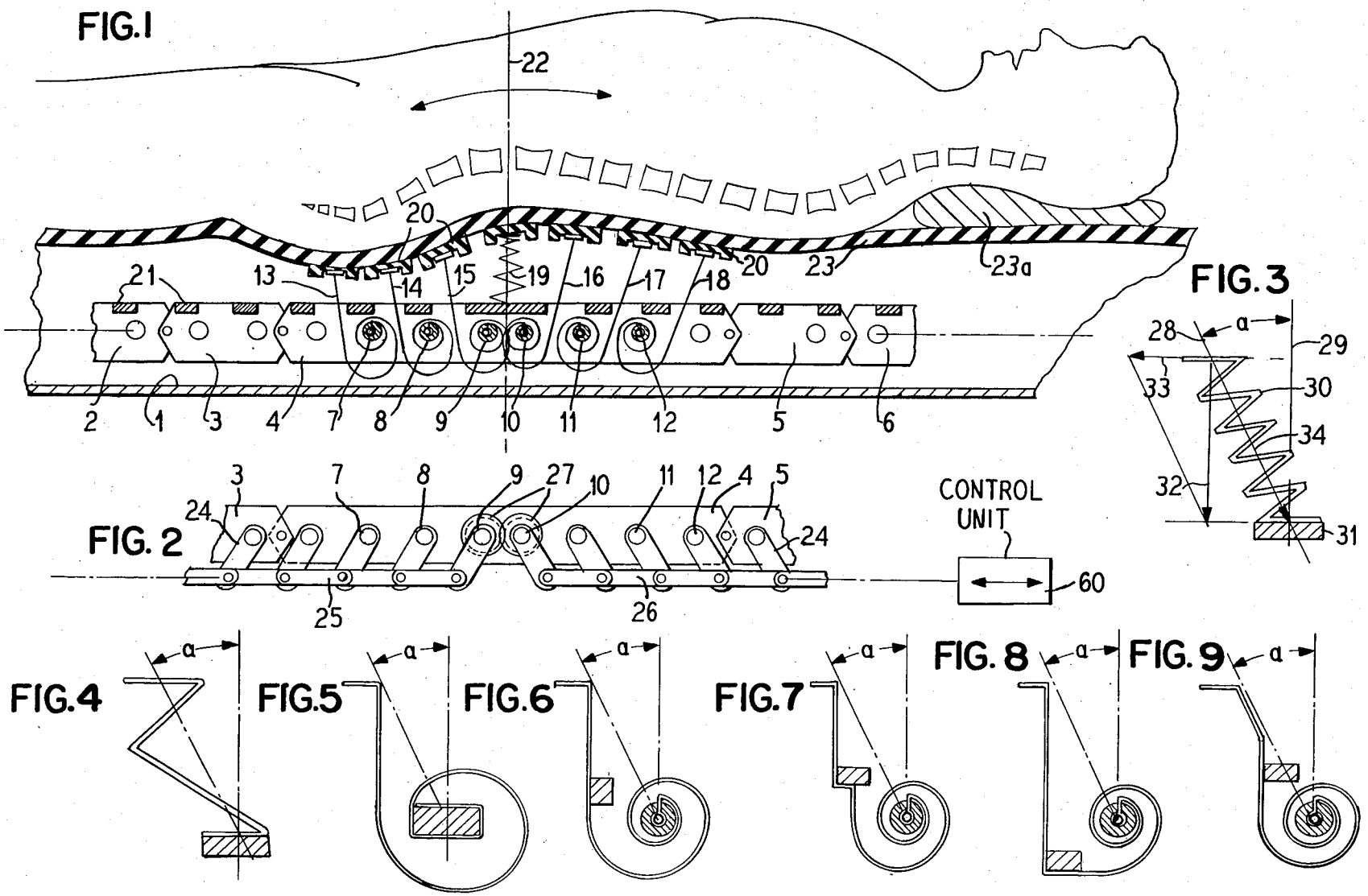
FIG. 1 is a longitudinal section through an innerspring mattress of the invention with a person lying thereupon.
FIG. 2 is a detailed view of the mattress according to FIG. 1.
FIGS. 3 through 9 are various spring embodiments for the mattress according to FIG. 1.

A semi-rigid framed structure integrated in a mattress 1 is shown in FIG. 1, said framed structure comprising frame parts 2 through 6 flexibly connected to one another. As shown in conjunction with the frame part 4, the frame parts 2 through 6 are provided with parallel axel-like supports 7 through 12, etc., on which flat coil springs 13 through 18 are seated. As shall be explained in greater detail below in conjunction with FIGS. 3 through 9, the respective work axis of the spring force of the flat coil springs 13 through 18 describes an angle with the perpendicular to the respective frame part 4 etc. which deviates from 0°. A force proceeding in the direction of the body surface is consequently exerted on the user lying on the free ends of the springs 13 through 18, etc. The springs 13 through 18, etc., can be aligned in rows such that this force proceeds obliquely in the direction toward the leg region in the region of the buttocks and obliquely in the direction toward the head in the back region. Stretching of the spine is thus achieved. A helical spring 19 which lies in the neutral region of the mattress and whose force acts on the user approximately perpendicular to the surface of the mattress is also shown in FIG. 1.

FIG. 1 shows that the supporting ends of the springs 13 through 18, etc., are covered with elastic caps 20 and are covered with elastic material 23. The frame parts 2 through 6 etc., are individually adjustable at the joints which connect them to one another so that it is possible to raise the head and foot portions. Such interconnected frame parts are, of course, a prior art construction and consequently have not been shown here in greater detail. They are also provided with rod-like stop bars 21, so that it is possible to pre-stress the springs 13 through 18 etc., by means of rotating the axes 7 through 12, the springs being thereby pressed against the detents. Each of the axes 7 through 12 etc. thus carries a row or series of springs of which only one is respectively visible in FIG. 1. A series of helical springs of which only the helical spring 19 is visible are also located, of course, at the apex 22. There is no fixed or rigid connection between the supporting ends of the springs 13 through 18, etc. The material 23 which covers the springs 13 through 18 at the top is elastic both in a longitudinal as well as a cross direction. A pillow *23a* is provided for a better definition of the prone position of the user; this pillow can be fixed in accordance with the user's height.

FIG. 2 shows an embodiment of a central drive for the axes 7 through 12, etc. Levers 24 which are hinged to adjustment rods 25, 26, etc. are secured to the axes 7 through 12, etc. The axes 9 and 10 are positively clutched to one another with the assistance of two gearwheels 27, so that all axes 7 through 12, etc., can be adjusted by control unit 60 for changing the spring pre-stress by means of displacing the adjustment rod 26 in the arrow direction. Furthermore, an individual adjustment of the spring pre-stress is also possible since the respective axis 7 through 12, etc., are rotated relative to the respective lever 24 by loosening the connection between these two components. A matching of the spring force to the partially differing body weight of the person lying thereon is thus possible.

The central adjustment with the assistance of adjustment rods 25, 26, etc., and of the lever 24 enables the user to adapt the hardness of the mattress as well as the extension force to his individual requirements by means of a simple lever actuation or by means of pressing a button with the activation of an electric motor.

FIG. 3 shows another embodiment of a wire spring for an innerspring mattress according to the invention. This is a helical spring wherein the work axis 28 of the spring force likewise forms an angle 'a' departing from 0° with the perpendicular 29 to the respective frame part 2 through 6, etc. The one end of the helical spring 30 of FIG. 3 is thus not seated on an axle but on a rod 31 having a rectangular cross-section. It is shown that the perpendicularly acting force 32 derived from the body weight can be dissected into a horizontal component 33 and into a component 34 lying in the direction of the work axis of the spring force.

FIGS. 4 through 9 show further possible spring designs as well as further possible dispositions of the detents for the spring pre-stress. FIG. 4 shows a stirrup spring and FIGS. 5 through 9 show various forms of coil springs.

The common characteristic of the wire or flat spiral springs according to FIGS. 3 through 9 as well as of the springs 13 through 18, etc., of FIG. 1 is that their work axes of the spring force describe an angle with the perpendicular to the respective frame part, or to the supporting surface as well, which deviates from 0°.

Although various minor changes and modifications might be proposed by those skilled in the art, it will be understood that I wish to include within the claims of the patent warranted hereon all such changes and modifications as reasonably come within my contribution to the art.

I claim as my invention:

1. An innerspring mattress spring assembly, comprising:

a plurality of springs which have securement ends attached at a frame and opposite support ends positioned to support an elastic material supporting surface upon which a user lies, said supporting surface forming a substantially planar surface prior to the user lying thereon;

said springs being designed and positioned such that a respective work axis of a spring force of each spring describes an angle with respect to a perpendicular of the planar surface on which the user lies such that a horizontal longitudinal component of the force is exerted longitudinally of the user through the supporting surface and a vertical component of the force vertically supports the user through the supporting surface;

said springs being secured in rows to parallel axel-like supports connected with the frame; and said axel-like supports comprise axles which are rotatably seated, and stop means are positioned relative to said springs such that said springs can be pre-stressed when in abutting contact with the stop means by means of rotating said axles.

2. An innerspring mattress spring assembly according to claim 1 wherein all axles are connected to one another by setting means such that all springs can be prestressed in common.

3. A mattress supporting assembly, comprising:

a flexible material supportng surface upon which a user lies;

a frame assembly comprising a plurality of pivotably linked frame parts in a row along a longitudinal direction of the frame assembly;

each frame part having at least one row formed by a plurality of springs, said row being transverse to the longitudinal direction;

a majority of said rows of springs each being formed by a rotatable spring securement member to which the plurality of springs in the row are attached;

each spring attached to the securement member comprising a flat spiral spring having one securement end and an opposite support end aubutting against said supporting surface;

means for rotating the securement member so as to change a spring tension of the flat spiral springs in a given row; and some of the rows having flat spiral springs aligned such that they exert a spring force on the supporting surface having one component of the force in a longitudinal direction toward a head of the user together with a vertical supporting component of the force and other rows have a component of the spring force directed toward lower body portions of the user and also a vertically directed component for supporting the user.

* * * * *